US010611141B2

(12) United States Patent
Shinohara

(10) Patent No.: US 10,611,141 B2
(45) Date of Patent: Apr. 7, 2020

(54) PRINTING DEVICE, PRINTING METHOD, AND NON-TRANSITORY RECORDING MEDIUM

(71) Applicant: CASIO COMPUTER CO., LTD., Shibuya-ku, Tokyo (JP)

(72) Inventor: Sumito Shinohara, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/138,720

(22) Filed: Sep. 21, 2018

(65) Prior Publication Data

US 2019/0091997 A1 Mar. 28, 2019

(30) Foreign Application Priority Data

Sep. 27, 2017 (JP) ..... 2017-187217

(51) Int. Cl.
*B41J 2/045* (2006.01)
*B41J 3/36* (2006.01)

(52) U.S. Cl.
CPC ..... *B41J 2/04505* (2013.01); *B41J 2/0458* (2013.01); *B41J 3/36* (2013.01)

(58) Field of Classification Search
CPC ..... B41J 25/006; B41J 29/38; B41J 2/04556; B41J 2/04508; B41J 2/04505; B41J 2/0458; B41J 3/36
See application file for complete search history.

(56) References Cited

U.S. PATENT DOCUMENTS

| | | | | |
|---|---|---|---|---|
| 6,062,686 | A | 5/2000 | Kinoshita et al. | |
| 7,355,736 | B2 | 4/2008 | Hoshino et al. | |
| 2002/0154186 | A1 * | 10/2002 | Matsumoto | B41J 3/28 347/14 |

FOREIGN PATENT DOCUMENTS

| | | | |
|---|---|---|---|
| JP | H09118048 | A | 5/1997 |
| JP | H09216433 | A | 8/1997 |
| JP | H1016316 | A | 1/1998 |
| JP | H10181108 | A | 7/1998 |
| JP | H1158847 | A | 3/1999 |
| JP | 2001225512 | A | 8/2001 |
| JP | 2003136786 | A | 5/2003 |
| JP | 2010214738 | A | 9/2010 |

* cited by examiner

*Primary Examiner* — Thinh H Nguyen
(74) *Attorney, Agent, or Firm* — Holtz, Holtz & Volek PC

(57) ABSTRACT

A printing device includes a print head that prints an image on a print medium while moving relatively to the print medium, a sensor that detects an amount of movement and a moving direction of a body of the printing device that are relative to the print medium, and a processor, wherein the processor causes the print head to execute printing of a first image according to the amount of movement when the moving direction that is detected by the sensor is a first direction, determines whether the body is separated from the print medium based on a detection result of the sensor after printing of the first image is finished, and causes the print head to execute printing of a second image according to the amount of movement when, after separation is determined, the sensor detects movement in a second direction that is a direction different from the first direction.

14 Claims, 9 Drawing Sheets

PRINTING DEVICE, PRINTING METHOD, AND NON-TRANSITORY RECORDING MEDIUM

CROSS-REFERENCE TO RELATED APPLICATION

This application is based upon and claims the benefit of priority under 35 USC 119 of Japanese Patent Application No. 2017-187217 filed on Sep. 27, 2017, the entire disclosure of which, including the description, claims, drawings, and abstract, is incorporated herein by reference in its entirety.

FIELD

This application relates generally to a printing device, a printing method, and a non-transitory recording medium.

BACKGROUND

Unexamined Japanese Patent Application Kokai Publication No. 2001-225512 describes a handy printer for printing an image on recording paper with a recording head while manually moving the printer body on the recording paper. With such a handy printer, if a scan roller is provided to the printer body to facilitate the operation to move the printer body in the horizontal direction as in the configuration that is described in Unexamined Japanese Patent Application Kokai Publication No. 2001-225512, it is easy to print characters or an image in one line in the horizontal direction. However, in the case of printing characters or an image in multiple lines, after printing one line, the printer body has to be moved in the vertical direction orthogonal to the horizontal direction to the next line position without being lifted. However, presence of the scan roller makes it difficult to move the printer body in the vertical direction. Therefore, such a handy printer has a problem in that it is difficult to print characters or an image in multiple lines. The present disclosure is made with the view of the above problem and advantageously facilitates printing of multiple lines with a handy printer that is movable along one direction.

SUMMARY

One mode of the printing device according to the present disclosure includes a print head that prints an image on a print medium while moving relatively to the print medium, a sensor that detects an amount of movement and a moving direction of a body of the printing device that are relative to the print medium, and a processor, wherein the processor causes the print head to execute printing of a first image according to the amount of movement when the moving direction that is detected by the sensor is a first direction, determines whether the body is separated from the print medium based on a detection result of the sensor after printing of the first image is finished, and causes the print head to execute printing of a second image according to the amount of movement when, after the separation is determined, the sensor detects movement in a second direction that is a direction different from the first direction.

One mode of the printing method according to the present disclosure is a printing method that is executed by a printing device wherein the printing device includes a print head that prints an image on a print medium while moving relatively to the print medium and a sensor that detects an amount of movement and a moving direction of a body of the printing device that are relative to the print medium, and the printing method causes the print head to print a first image according to the amount of movement when one of a first direction and a second direction that is a direction different from the first direction is detected as the moving direction, determines whether the body is separated from the print medium based on a detection result of the sensor after printing of the first image is finished, and causes the print head to execute printing of a second image according to the amount of movement when, after the separation is determined, the sensor detects movement in the second direction.

One mode of the non-transitory recording medium according to the present disclosure records a program that allows a computer of a printing device that includes a print head that prints an image on a print medium while moving relatively to the print medium and a sensor that detects an amount of movement and a moving direction of a body of the printing device that are relative to the print medium to execute processing of causing the print head to execute printing of a first image according to the amount of movement when one of a first direction and a second direction that is a direction different from the first direction is detected as the moving direction, determining whether the body is separated from the print medium based on a detection result of the sensor after printing of the first image is finished, and causing the print head to execute printing of a second image according to the amount of movement when, after the separation is determined, the sensor detects movement in the second direction.

BRIEF DESCRIPTION OF THE DRAWINGS

A more complete understanding of this application can be obtained when the following detailed description is considered in conjunction with the following drawings, in which.

DETAILED DESCRIPTION

A printing device 1 according to Embodiment 1 will be described with reference to the drawings. Here, the same or corresponding parts are referred to by the same reference numbers.

Figure 1A:
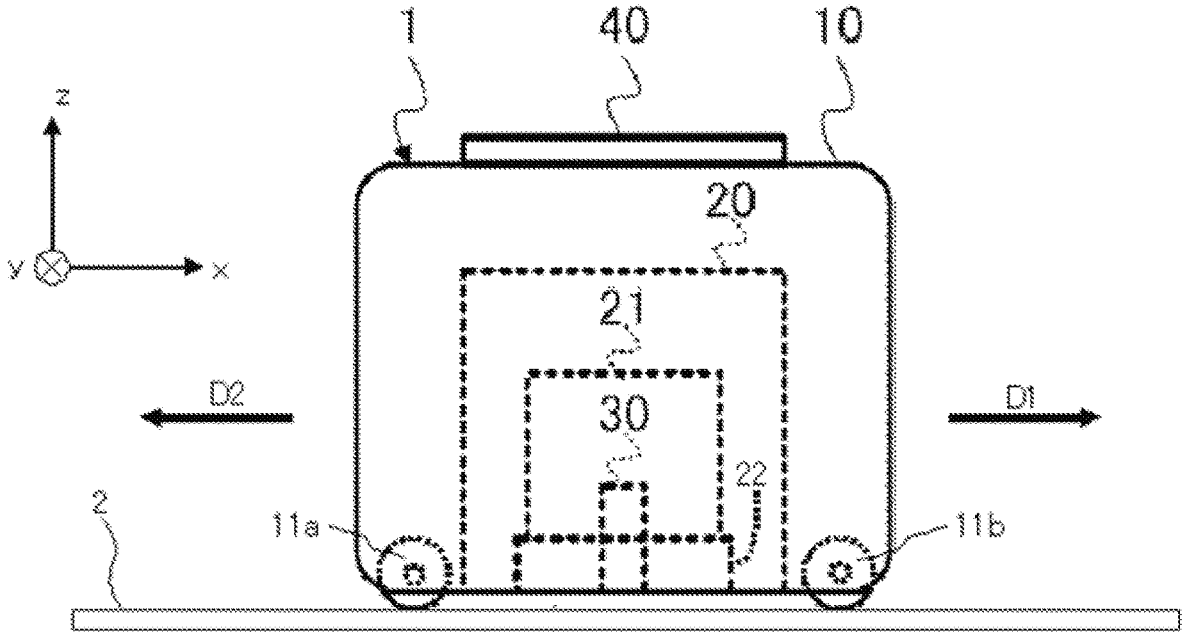
FIG. 1A is a side view of the printing device according to Embodiment 1.
Figure 1B:
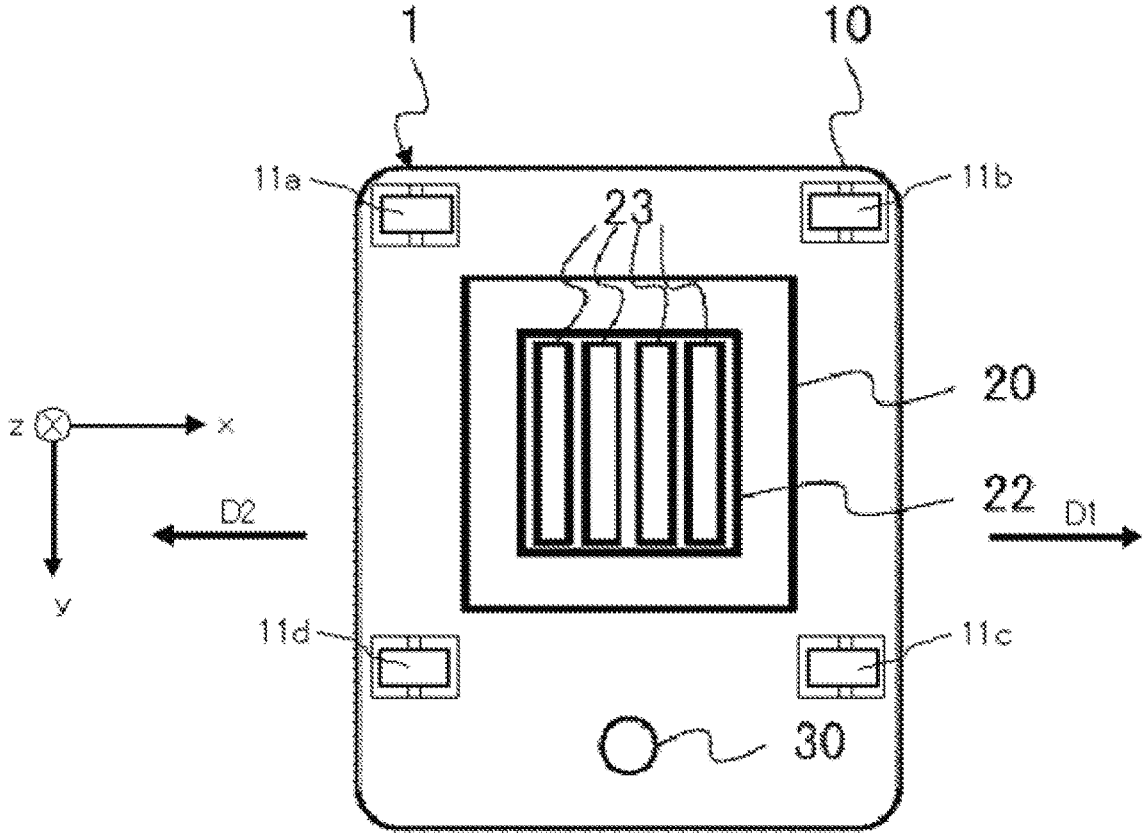
FIG. 1B is a bottom view of the printing device according to Embodiment 1.
Figure 1C:
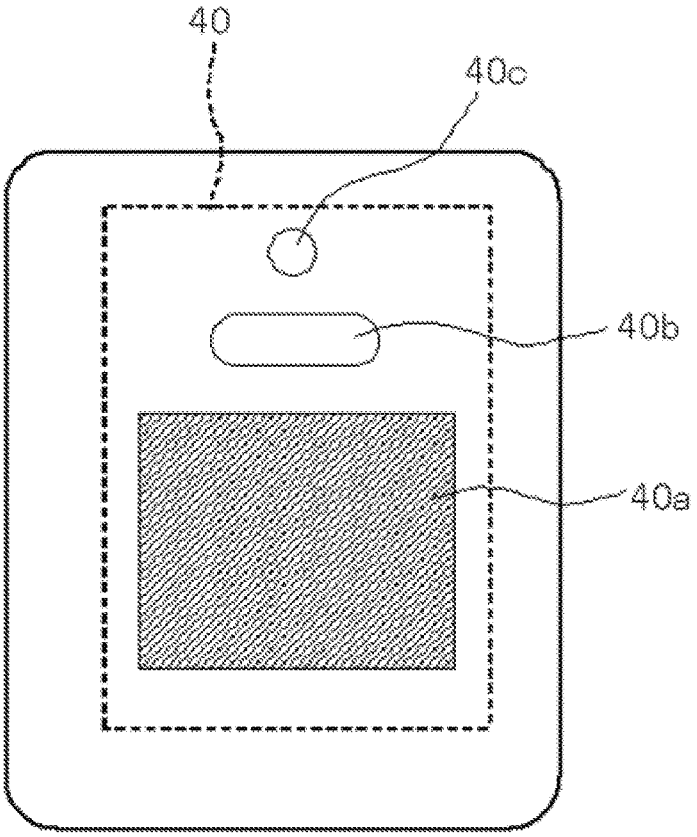
FIG. 1C is a top view of the printing device according to Embodiment 1.

FIG. 1A is a side view of the printing device 1 according to Embodiment 1, FIG. 1B is a bottom view thereof, and FIG. 1C is a top view thereof. The printing device 1 is a manual-scan type printing device that makes it possible for the user to print a print-target image on a print medium 2 by moving the device on the print medium 2 along a moving direction D1 or D2. Such a manual-scan type printing device is also called a handy printer or a direct printer. Here, xyz axes of coordinate as shown in FIG. 1 are set. The x-axis and the y-axis are parallel to the surface direction of the print medium 2 and the z-axis is perpendicular to the x-axis and the y-axis. In the following explanation, a case is described in which the user moves the printing device 1 in the moving direction D1 or D2 along the x-axis to print on the print medium 2. Moreover, the y-axis direction is also referred to as the back and the z-axis direction is also referred to as the top. Here, the left-to-right moving direction D1 is referred to as "the forward direction" and the right-to-left moving direction D2 is referred to as "the backward direction."

The print medium 2 can include, but not limited to, print paper, print labels, and cardboard. The print medium 2 is also referred to as a recording medium or a print object. The print medium 2 is formed of paper or resin. However, the print medium 2 can be anything that is formed of a material to which ink can adhere with a surface condition under which ink can adhere.

Figure 2:
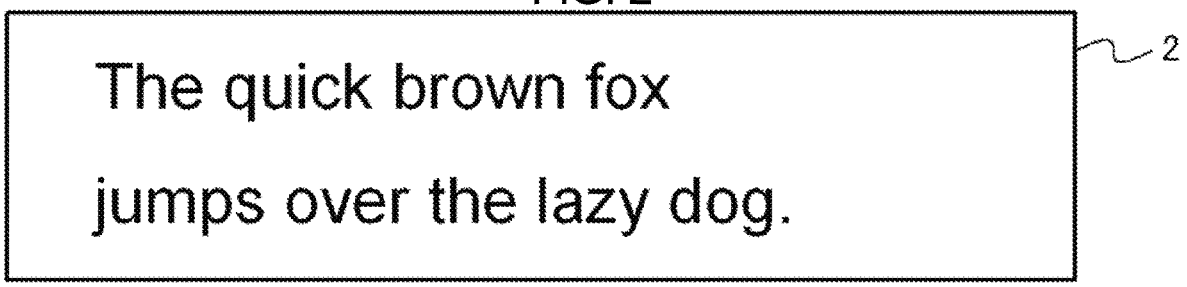
FIG. 2 is an illustration that shows a print-target image that is printed by the printing device according to Embodiment 1.

The print-target image (content) can include, but not limited to, characters, symbols, figures, patterns, drawings, and pictures. The print-target image is also referred to as a print image or a print pattern. FIG. 2 is an illustration that shows a print-target image that is printed by the printing device 1. In this embodiment, as shown in FIG. 2, a case of printing text that is composed of two lines:

The quick brown fox
jumps over the lazy dog.

is described. Here, the print-target image is not restricted to text that is composed of two lines and may be text that is composed of multiple, three or more, lines or may be not text but symbols, any images, or the like.

Figure 3:
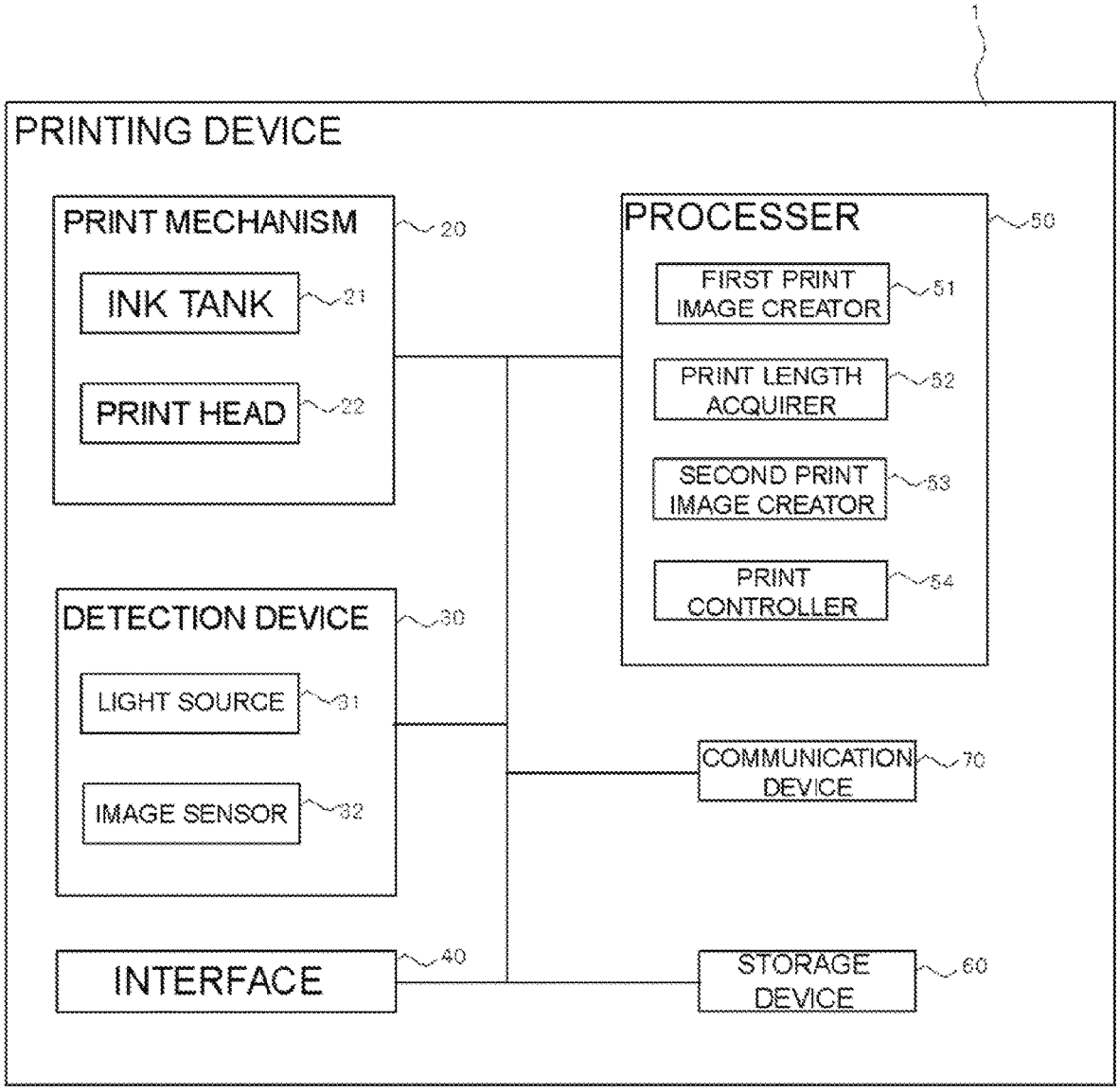
FIG. 3 is a block diagram that shows the configuration of the printing device according to Embodiment 1.

FIG. 3 is a block diagram that shows the configuration of the printing device 1. As shown in FIGS. 1A to 1C and FIG. 3, the printing device 1 according to Embodiment 1 includes an enclosure (body of the printing device) 10, rotating rollers (moving direction restrictors) 11*a* to 11*d*, a print mechanism 20, a detection device 30, an interface 40, a processor 50, a storage device 60, and a communication device 70.

The enclosure 10 is an enclosure in which the rotating rollers 11*a* to 11*d*, the print mechanism 20, the detection device 30, the interface 40, the processor 50, and the storage device 60, which are components of the printing device 1, are disposed. As shown in FIGS. 1A and 1B, the rotating rollers 11*a* to 11*d*, the print mechanism 20, the detection device 30, and the interface 40 are exposed from the enclosure 10. The enclosure 10 is formed of, for example, resin or metal but not restricted thereto.

The print mechanism 20 is disposed on the underside of the enclosure 10 and prints a print-target image on the print medium 2. The print mechanism 20 includes an ink tank 21 that is filled with ink and a print head 22 that atomizes and ejects the ink contained in the ink tank 21. The print mechanism 20 performs inkjet printing. The ink tank 21 supplies ink to the print head 22. The print head 22 includes multiple nozzles 23 that are arrayed along the y-direction and the x-direction. The print head 22 heats the ink within the nozzles 23 with a heater to form air bubbles and ejects the ink from the individual nozzles 23 to the print medium 2 by means of the formed air bubbles.

The detection device 30 is a sensor that detects the amount of movement and the moving direction of the printing device 1 including the print mechanism 20 with respect to the print medium 2. As shown in FIG. 3, the detection device 30 includes a light source 31 and an image sensor 32. The light source 31 is formed of, for example, a light emitting diode (LED). With the image sensor 32 reading light that is emitted by the light source 31 and reflected on the print medium 2 and comparison of the read light before and after the movement, the detection device 30 detects the amount of movement and the moving direction of the printing device 1. The detection device 30 provides to the processor 50 data including the detected amount of movement and moving direction.

The processor 50 determines whether a detection signal that is output by the detection device 30 satisfies a preset lifting condition and if the lifting condition is satisfied, detects the state of the printing device 1 being lifted. The lifting condition refers to a state in which the printing device 1 is lifted away from the print medium 2 and also is separated from the print medium 2 by a preset distance or more. While the printing device 1 is in the normal print state, the distance between the detection device 30 and the print medium 2 is smaller than the set distance. The lifting condition and the distance thereof are preset by any method such as experiments. It is unfavorable for the printing device 1 to continue printing and keep ejecting ink while the printing device 1 is in the lifted state; therefore, the processor 50 suspends printing when the lifted state is detected. Moreover, the detection device 30 detects the amount of movement and the moving direction of the printing device 1 when the lifting condition is not satisfied, the printing device 1 is properly placed on the print medium 2, and the detection device 30 and the print medium 2 are not separated by the set distance or more. Moreover, in this embodiment, for example in the case of printing two-line text, for moving the printing device 1 to the position to start the second line text after printing the first line text, the printing device 1 is lifted from the print medium 2 after printing the first line text and moved to the position to start the second line text, and then the second line text is printed.

The rotating rollers 11*a* to 11*d* are exposed in part from the underside of the enclosure 10 as shown in FIGS. 1A and 1B and rotatable in the direction to move the printing device 1 in the moving direction D1 or D2 in moving the printing device 1 with the rotating rollers 11*a* to 11*d* in contact with the print medium 2. The rotating rollers 11*a* to 11*d* are formed of, for example, rubber or a resin material and configured to allow the printing device 1 to linearly move along the moving direction D1 or D2.

The interface 40 is an interface that receives from the user input including print-target text and print start and print stop orders and presents information to the user. The interface 40 provides the received input to the processor 50 and presents to the user information that is acquired from the processor 50. The interface 40 can include, but not limited to, buttons, keys, or a touch pad for receiving input from the user, a liquid crystal display, a speaker, or an LED for presenting information to the user, or a touch panel for the both. FIG. 1C shows an exemplary case in which the interface 40 includes a display 40*a*, a print start button 40*b*, and a state indicator (LED) 40*c*.

The processor 50 is a processing device that includes a central processing unit (CPU) and executes programs to control the printing device 1. The processor 50 includes a first print image creator 51, a print length acquirer 52, a second print image creator 53, and a print controller 54. The processor 50 can include, but not limited to, a central processing unit (CPU). The communication device 70 performs wireless or wired informative communication with an external electronic device, for example an electronic device such as a personal computer, a smartphone, and a tablet. In the following explanation, a case is described in which the interface 40 receives user input of text to print. However, text or an image to print may be received from an external electronic device via the communication device 70 in some modes.

The first print image creator 51 creates a first print image based on the user input. As the interface 40 receives user input of text to print, the first print image creator 51 acquires the entered text from the interface 40. Furthermore, as the interface 40 receives user input of settings on the size, color, decoration, and layout of characters to print, the first print image creator 51 acquires the entered settings from the interface 40. The first print image creator 51 creates a first print image from the acquired text and settings and stores the first print image in the storage device 60.

Figure 4:
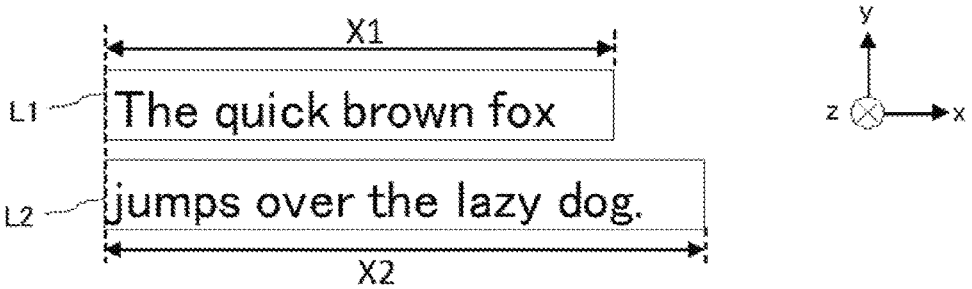
FIG. 4 is an illustration that shows a first print image that is created by the first print image creator in Embodiment 1.

FIG. 4 is an illustration that shows a first print image that is created by the first print image creator 51. The first print image creator 51 creates a first print image on a line basis. The first print image includes a first image L1 for the first line that reads "The quick brown fox" and a second image L2 for the second line that reads "jumps over the lazy dog." The length of the first image L1 from the left end to the right end along the x-direction is X1 and the length of the second image L2 from the left end to the right end along the x-direction is X2. The horizontal direction of the print image corresponds to the x-direction of the printing device 1.

Figure 5:
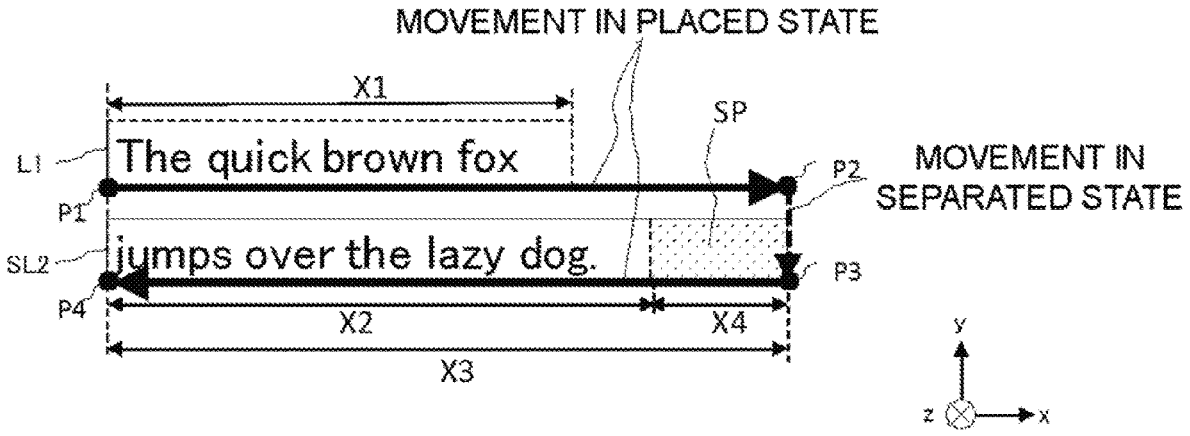
FIG. 5 is an illustration that shows a second print image that is created by the second print image creator in Embodiment 1.

The print length acquirer 52 acquires a print length based on the movement of the printing device 1. The print length is X3 that is shown in FIG. 5. When the length X2 of the second image L2 is larger than the length X1 of the first image L1, the print length X3 is set to a length equal to or larger than the length X2 of the second image L2. Specifically, assuming that the printing device 1 starts printing the first image L1, moves in the forward direction along the x-direction, finishes printing of the first image L1, and goes beyond the length X2 of the second image L2, and then the state of the printing device 1 being lifted is detected, the moving distance of the printing device 1 from start of printing to detection of the state of being lifted is acquired as the print length X3. Here, when the length X1 of the first image L1 is larger than the length X2 of the second image L2, the print length X3 is set to a length equal to or larger than the length X1 of the first image L1.

The second print image creator 53 creates a second print image SL2 for printing the second image L2 for the second line while moving the printing device 1 in the backward direction based on the first print image that is stored in the storage device 60 and the length of the print length X3. The second print image creator 53 subtracts the length X2 of the second image L2 for the second line from the print length X3 to calculate a length X4 along the x-direction of a space SP that should be added at the right end of the second image L2 for the second line. In other words, X4=X3−X2. Then, the second print image creator 53 creates and stores in the storage device 60 an image in which the space SP having the calculated length X4 is added at the right end of the second image L2 for the second line as the second print image SL2. The space SP is a region in which no print is made by the print mechanism 20. FIG. 5 shows the second print image SL2.

When it is detected based on the detection result of the detection device 30 that the printing device 1 is at a position P1 on the print medium 2 and the printing device 1 is properly placed on the print medium 2 and then the interface 40 receives a print start order, the print controller 54 acquires print start order information from the interface 40 and controls the print mechanism 20 to start printing. At this point, the enclosure 10 is held by the user and moved in the forward direction along the area in which the user wants to print. The print controller 54 controls the print mechanism 20 to print the first image L1 for the first line of the first print image from the left end while acquiring the amount of movement that is detected by the detection device 30 and calculating the position of the print mechanism 20 with respect to the print medium 2.

In the case that there is a second image L2 for the second line, when the printing device 1 moves to a position P2 on the print medium 2 and the moving distance of the printing device 1 since the print start time is larger than the larger one of X1 and X2 based on the length X1 of the first image L1 for the first line and the length X2 of the second image L2 for the second line, the print controller 54 notifies the user that the user can stop moving the printing device 1 and move the printing device 1 to the position for the second line via the interface 40, for example by means of display on the display 40*a* or emission of the LED of the state indicator 40*c*.

Then, if the state of the printing device 1 being lifted from the print medium 2 by the user and separated from the print medium 2 is detected, the print length acquirer 52 acquires as the print length X3 the moving distance of the printing device 1 from the print start of the printing device 1 to the time of the separated state being detected. Then, the second print image creator 53 creates based on the print length X3 a second print image SL2 in which a space is added at the right end of the second image L2 for the second line. Next, as it is detected that the printing device 1 is placed at a position P3 on the print medium 2 and started to move in the backward direction by the user, the print controller 54 controls the print mechanism 20 to print the second print image SL2 from the right end while acquiring the amount of movement that is detected by the detection device 30 and calculating the position of the print mechanism 20 with respect to the print medium 2. Then, as the printing device 1 moves to a position P4 and prints the entire print image to print, the print controller 54 controls the print mechanism 20 to stop printing.

The storage device 60 stores programs and data for the processor 50 to execute the processing and functions as the work area for the processor 50 to execute the processing. The storage device 60 can store a program for controlling the print mechanism 20 to print, a program for controlling the detection device 30 to detect the amount of movement, a program for creating print images, and data of the created print images. However, what is stored is not restricted to these. The storage device 60 can include, but not limited to, a read only memory (ROM) and a random access memory (RAM).

Figure 6:
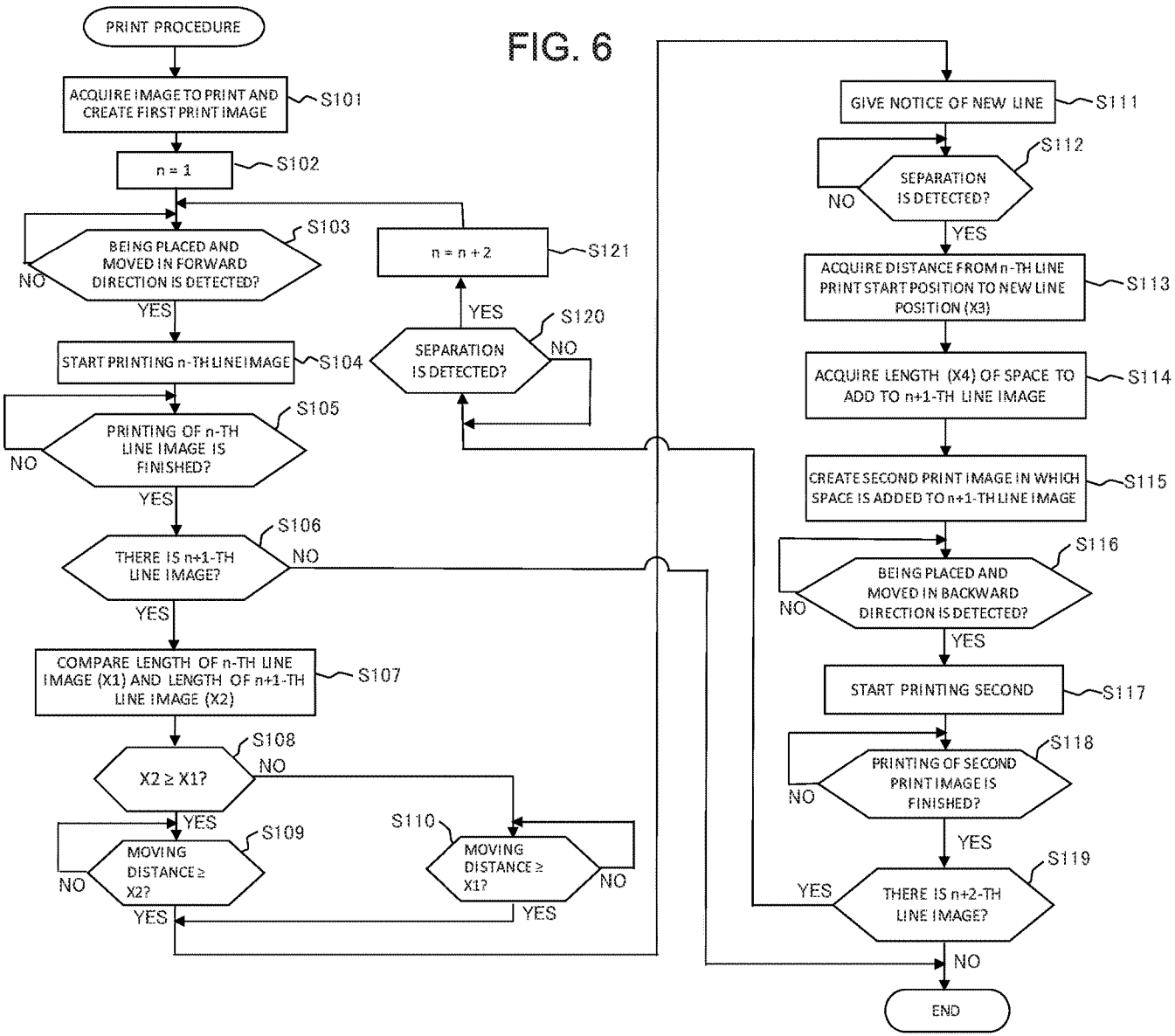
FIG. 6 is a flowchart of the print procedure in Embodiment 1.

FIG. 6 is a flowchart of the print procedure in Embodiment 1. The print procedure that is executed by the printing device 1 according to Embodiment 1 will be described with reference to the flowchart of FIG. 6. Here, in this embodiment and embodiments described later, a case is described in which print images are printed in left alignment. When print images are printed in right alignment, the right and the left are reversed in the following explanation.

The first print image creator 51 acquires from the interface 40 text (an image) to print and settings on the text (the image) to print that are entered by the user (Step S101).

Acquiring the text (the image) to print, the first print image creator 51 creates and stores in the storage device 60 a first print image.

After n is set to 1 (Step S102), it is determined based on the detection result of the detection device 30 whether it is detected that the printing device 1 is properly placed on the print medium 2 and the printing device 1 is moved in the forward direction with respect to the print medium 2 (Step S103). If the printing device 1 is not properly placed on the print medium 2 or it is not detected that the printing device 1 is moved in the forward direction with respect to the print medium 2 (Step S103: NO), the determination is repeated until it is detected that the printing device 1 is properly placed on the print medium 2 and the printing device 1 is moved in the forward direction with respect to the print medium 2.

On the other hand, if it is detected that the printing device 1 is properly placed on the print medium 2 and the printing device 1 is moved in the forward direction with respect to the print medium 2 (YES in step S103), printing of the first image L1 for the first line is started from the left end of the first image L1 for the first line based on the amount of movement of the printing device 1 that is detected by the detection device 30 (Step S104).

Then, it is determined whether printing of the first image L1 for the first line is finished (Step S105). If printing of the first image L1 is not finished (Step S105: NO), the determination is repeated. On the other hand, if determined that printing of the first image L1 for the first line is finished (YES in step S105), it is determined whether the first print image has a second image L2 for the second line (Step S106). Then, if determined that there is no second image L2 for the second line (Step S106: NO), the print procedure ends.

On the other hand, if determined that there is a second image L2 for the second line (YES in step S106), the length X1 of the first image L1 for the first line is compared with the length X2 of the second image L2 for the second line (Step S107). Then, if the length X2 of the second image L2 for the second line is equal to or larger than the length X1 of the first image L1 for the first line (YES in step S108), it is determined whether the moving distance of the printing device 1 since the print start time based on the amount of movement of the printing device 1 that is detected by the detection device 30 is equal to or larger than the length X2 of the second image L2 for the second line (Step S109). If the moving distance of the printing device 1 is smaller than the length X2 of the second image L2 for the second line (NO in step S109), the determination is repeated. On the other hand, if the length X2 of the second image L2 for the second line is smaller than the length X1 of the first image L1 for the first line (NO in step S108), it is determined whether the moving distance of the printing device 1 since the print start time based on the amount of movement of the printing device 1 that is detected by the detection device 30 is equal to or larger than the length X1 of the first image L1 for the first line (Step S110). If the moving distance of the printing device 1 is smaller than the length X1 of the first image L1 for the first line (NO in step S110), the determination is repeated.

Next, if the length X2 of the second image L2 for the second line is equal to or larger than the length X1 of the first image L1 for the first line and the moving distance of the printing device 1 is equal to or larger than the length X2 of the second image L2 for the second line (YES in step S109), or if the length X2 of the second image L2 for the second line is smaller than the length X1 of the first image L1 for the first line and the moving distance of the printing device 1 is equal to or larger than the length X1 of the second image L1 for the first line (YES in step S110), the user is notified via the interface 40 that the user can stop moving the printing device 1 and move the printing device 1 to the right end position for the second line (a new line) (Step S111). In such a case, the user is notified that the user can move the printing device 1 to the position for the second line (a new line) by means of, for example, display on the display 40*a* or emission of the LED of the state indicator 40*c*.

Next, it is determined whether the state of the printing device 1 being separated from the print medium 2 is detected (Step S112). If the state of being separated from the print medium 2 is not detected (NO in step S112), the determination is repeated.

On the other hand, if determined that the state of the printing device 1 being separated from the print medium 2 is detected (YES in step S112), the distance between the positions of the printing device 1 (the moving distance) at which printing of the first image L1 for the first line is started (the print start position) and at which the state of being separated from the print medium 2 is detected (the new line position) is acquired as the print length X3 (Step S113).

Next, the length X2 of the second image L2 for the second line is subtracted from the acquired print length X3 to acquire a length X4 along the x-direction of a space SP that should be added at the right end of the second image L2 for the second line (Step S114). Then, an image in which the space SP having the calculated length X4 is added at the right end of the second image L2 for the second line is created as the second print image SL2 and stored in the storage device 60 (Step S115).

Next, it is determined based on the detection result of the detection device 30 whether it is detected that the printing device 1 is properly placed on the print medium 2 and the printing device 1 is moved in the backward direction with respect to the print medium 2 (Step S116). If the printing device 1 is not properly placed on the print medium 2 or it is not detected that the printing device 1 is moved in the backward direction with respect to the print medium 2 (NO in step S116), the determination is repeated until it is detected that the printing device 1 is properly placed on the print medium 2 and the printing device 1 is moved in the backward direction with respect to the print medium 2.

On the other hand, if it is detected that the printing device 1 is properly placed on the print medium 2 and the printing device 1 is moved in the backward direction with respect to the print medium 2 (YES in step S116), printing of the second print image SL2 is started from the right end of the second print image SL2 based on the amount of movement of the printing device 1 that is detected by the detection device 30 (Step S117).

Then, it is determined whether printing of the second print image SL2 is finished (Step S118). If printing of the second image SL2 is not finished (NO in step S118), the determination is repeated.

On the other hand, if determined that printing of the second print image SL2 is finished (YES in step S118), it is determined whether the first print image has an image for the third line (Step S119). Then, if there is no image for the third line (Step S119: NO), the print procedure ends.

On the other hand, if determined that the first print image has an image for the third line (YES in step S119), it is determined whether the state of the printing device 1 being separated from the print medium 2 is detected (Step S120). If the state of being separated from the print medium 2 is not detected (NO in step S120), the determination is repeated.

On the other hand, if determined that the state of the printing device 1 being separated from the print medium 2 is detected (YES in step S120), n is set to 3 (Step S121), the processing returns to the Step S103, and the above operation is repeated from then on.

Figure 7:
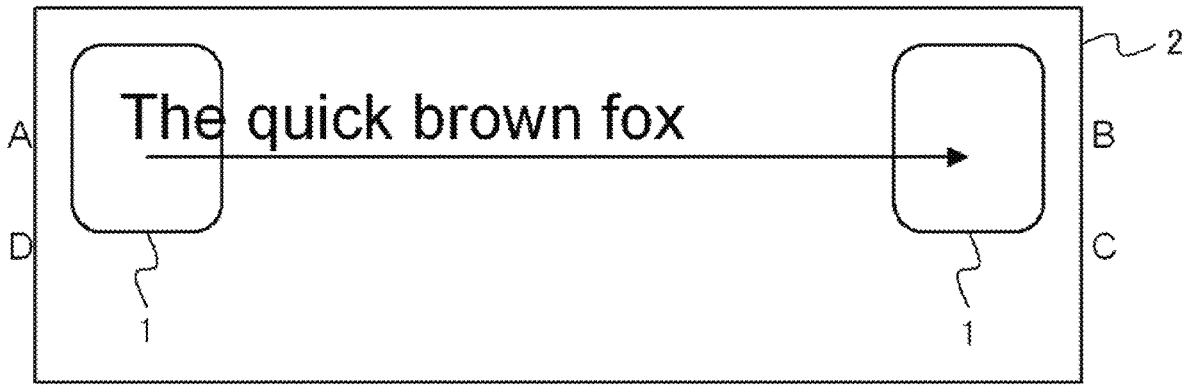
FIG. 7 is an illustration that shows a process of printing a print image on the print medium in Embodiment 1.
Figure 8:
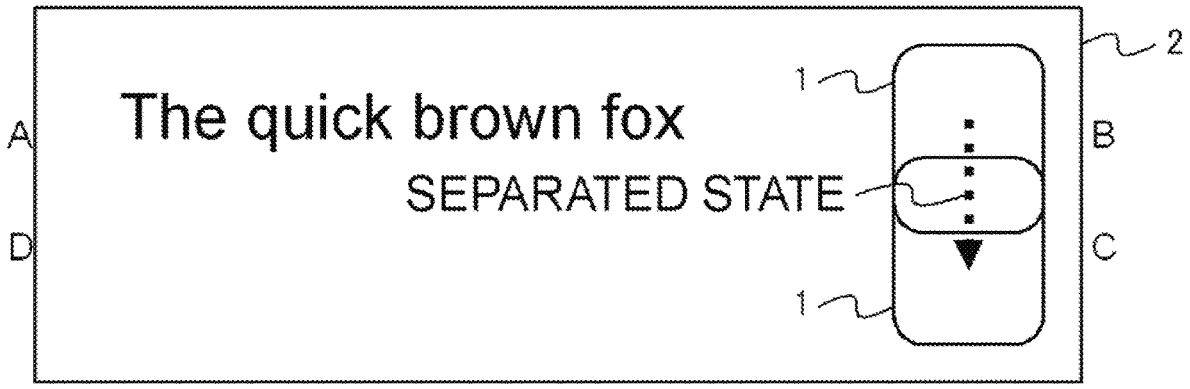
FIG. 8 is an illustration that shows a process of printing a print image on the print medium in Embodiment 1.
Figure 9:
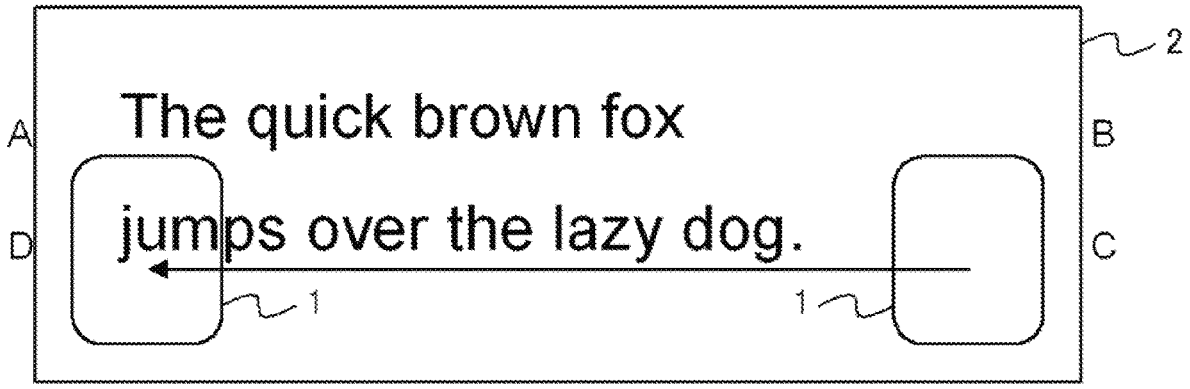
FIG. 9 is an illustration that shows a process of printing a print image on the print medium in Embodiment 1.

FIGS. 7 to 9 are illustrations that show the process of printing a print image on the print medium 2. The printing processes that are performed in the Steps S107 to S121 will be described with reference to FIGS. 7 to 9. In FIGS. 7 to 9, the interface 40 of the printing device 1 is not shown.

As shown in FIG. 7, the user holds the enclosure 10 and moves the printing device 1 in the forward direction from a point A to a point B on the print medium 2. Meanwhile, the print controller 54 controls the print mechanism 20 based on the amount of movement of the printing device 1 that is detected by the detection device 30 to print the first image L1 for the first line in the forward direction on the print medium 2 (Step S104). Then, as the printing device 1 prints the first image L1 and moves to a point that is far by the length X2 of the second image L2 for the second line or more (the point B), the printing device 1 is in the state of being ready for moving to the right end of the second line. At this point, the printing device 1 notifies the user of being in such a state via the interface 40.

Next, as shown in FIG. 8, the user lifts the printing device 1 from the print medium 2 at the point B, moves the printing device 1 to a point C (Step S112), and places the printing device 1 on the print medium 2 at the point C.

Next, the printing device 1 is moved from the point C to a point D, and the print mechanism 20 is controlled based on the amount of movement of the printing device 1 that is detected by the detection device 30 to print the second image L2 for the second line in the backward direction on the print medium 2 (Step S117).

(Embodiment 2)

The printing device 1 according to Embodiment 2 will be described with reference to the drawings.

In the above-described Embodiment 1, it is assumed that the printing device 1 is manually moved. In such a case, since the printing device 1 has the rotating rollers 11*a* to 11*d*, it is relatively easy to move the printing device 1 linearly along the moving direction D1 or D2. However, for lifting and moving the printing device 1 from the right end position of the first line to the right end position of the second line, because of manual operation, the direction in which the printing device 1 is moved may be deviated from the direction orthogonal to the moving directions D1 and D2. Then, in Embodiment 2, in addition to the printing device 1, a printing assist jig 3 for guiding and assisting in moving the printing device 1 is used.

Figure 10A:
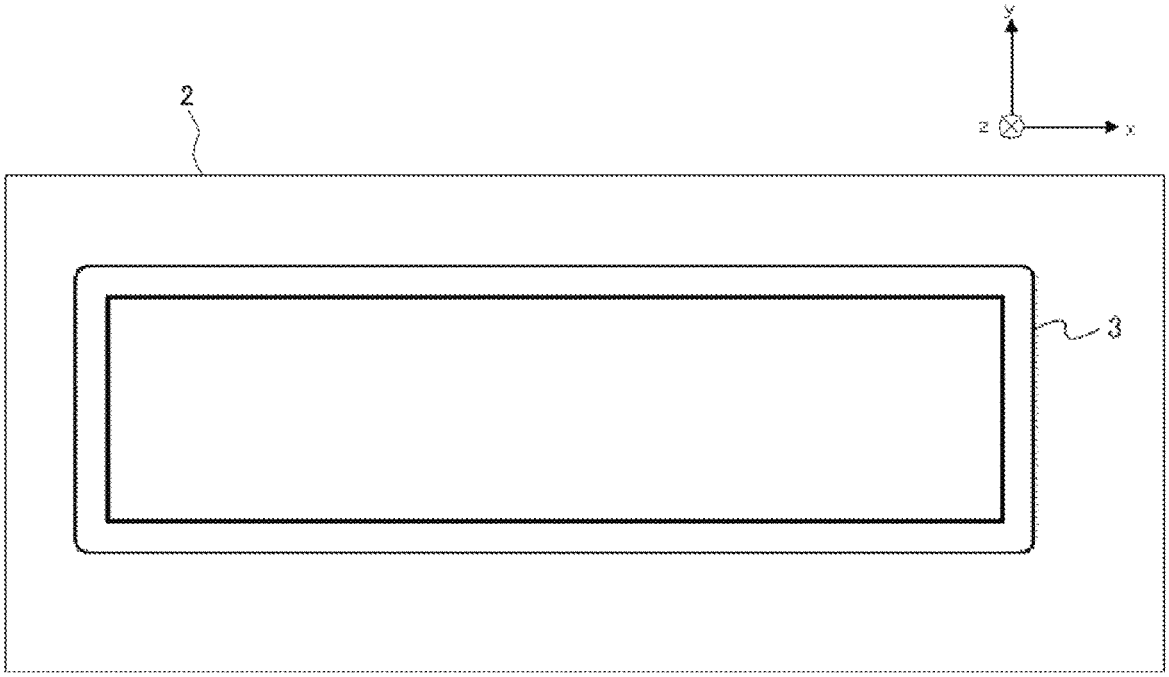
FIG. 10A is an illustration that shows the printing assist jig in Embodiment 2.
Figure 10B:
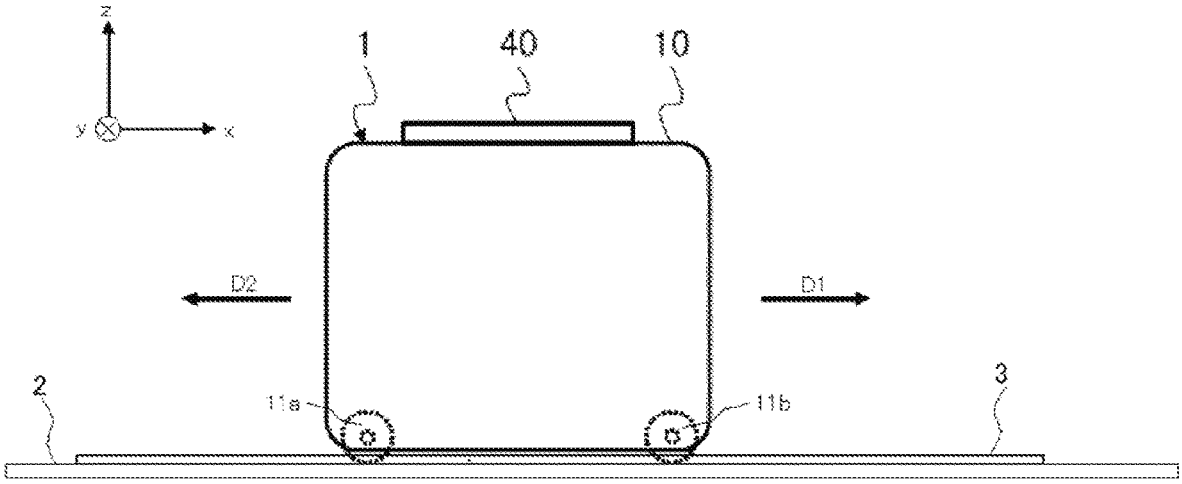
FIG. 10B is an illustration that shows the printing device and the printing assist jig in Embodiment 2.

FIG. 10A is a top view of the printing assist jig 3 and FIG. 10B is a side view of the printing device 1 printing with the use of the printing assist jig 3. The printing assist jig 3 is a jig that assists the user in moving the printing device 1. As shown in FIG. 10A, the printing assist jig 3 has a hollow rectangular shape. Although not restrictive, the printing assist jig 3 is formed of resin or metal. The printing assist jig 3 is placed on the print medium 2 for printing on the print medium 2 with the printing device 1. The printing assist jig 3 is formed to a thickness that allows the printing assist jig 3 to be interposed between the bottom surface of the printing device 1 and the print medium 2 when the printing device 1 is placed on the print medium 2 as shown in FIG. 10B.

For using the printing assist jig 3, the user places the printing assist jig 3 on the print medium 2 with the longitudinal direction of the printing assist jig 3 in the x-direction and the inner edge of the printing assist jig 3 at the intended print position. Then, for moving the printing device 1 in the moving direction D1 or D2, the printing device 1 is moved with any of the rotating rollers 11*a* to 11*d* of the printing device 1 in contact with the inner edge of the printing assist jig 3 and any of the rotating rollers 11*a* to 11*d* slid on the printing assist jig 3. As a result, it is possible to move the printing device 1 without meandering in a range that is determined by the printing assist jig 3. Moreover, for lifting and moving the printing device 1 from the right end position of the first line to the right end position of the second line, the position of the printing assist jig 3 is adjusted so that any of the rotating rollers 11*a* to 11*d* makes contact with the inner edge of the printing assist jig 3 when the printing device 1 is placed at the right end position of the first line and any of the rotating rollers 11*a* to 11*d* makes contact with the inner edge of the printing assist jig 3 when the printing device 1 is lifted and moved to the right end position of the second line. In this way, it is possible to suppress deviation of the moving direction of the printing device 1.

An example of the specific way of moving the printing device 1 with the use of the printing assist jig 3 will be described with reference to FIGS. 11 to 14. In FIGS. 11 to 14, the interface 40 of the printing device 1, part of the printing assist jig 3, and a printed image are not shown.

Figure 11:
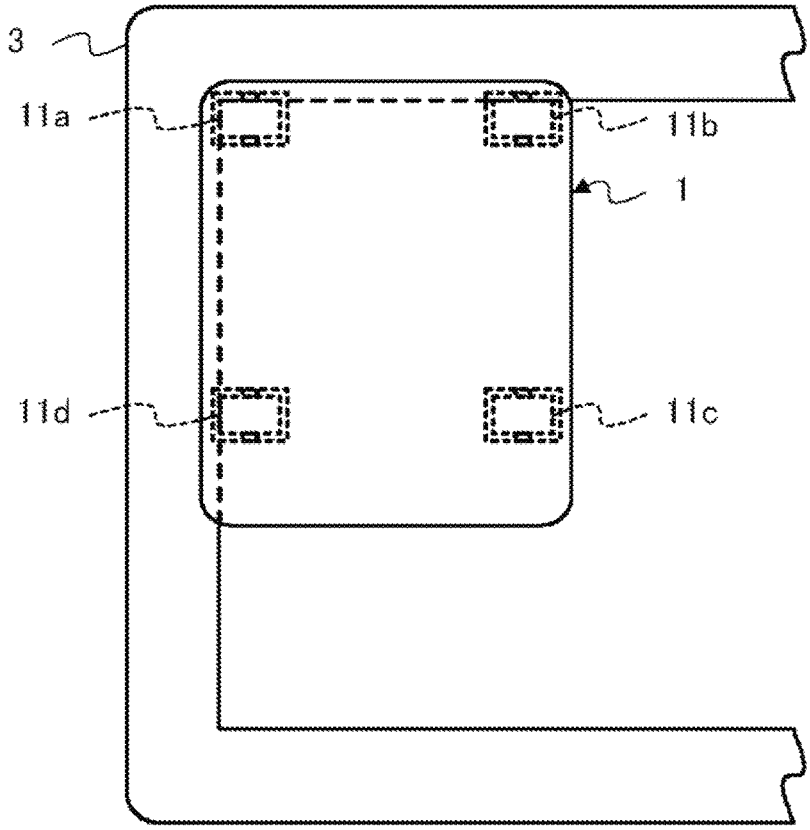
FIG. 11 is a top view of the printing device and the printing assist jig according to Embodiment 2.
Figure 12:
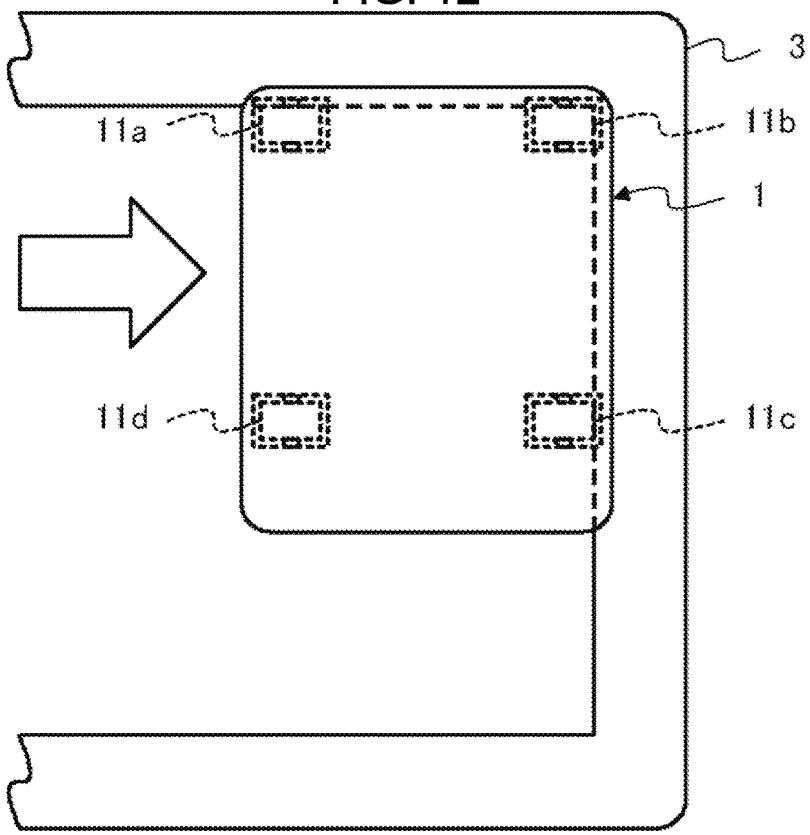
FIG. 12 is a top view of the printing device and the printing assist jig according to Embodiment 2.

As shown in FIG. 11, the user disposes the printing device 1 with the rotating rollers 11*a*, 11*b*, and 11*d* in contact with a corner part of the inner edge of the printing assist jig 3. Specifically, the rotating roller 11*a* is in contact with the top left corner of the inner edge of the printing assist jig 3; the rotating roller 11*b*, in contact with the top edge; and the rotating roller 11*d*, in contact with the left edge.

After disposing the printing device 1 as described above, as shown in FIG. 12, the user holds the enclosure 10 and slides the rotating rollers 11*d* and 11*b* on the printing assist jig 3 to move the printing device 1 in the forward direction until the rotating roller 11*b* makes contact with the top right corner of the inner edge of the printing assist jig 3. Meanwhile, the print controller 54 controls the print mechanism 20 to print the first image L1 for the first line in the forward direction on the print medium 2.

Figure 13:
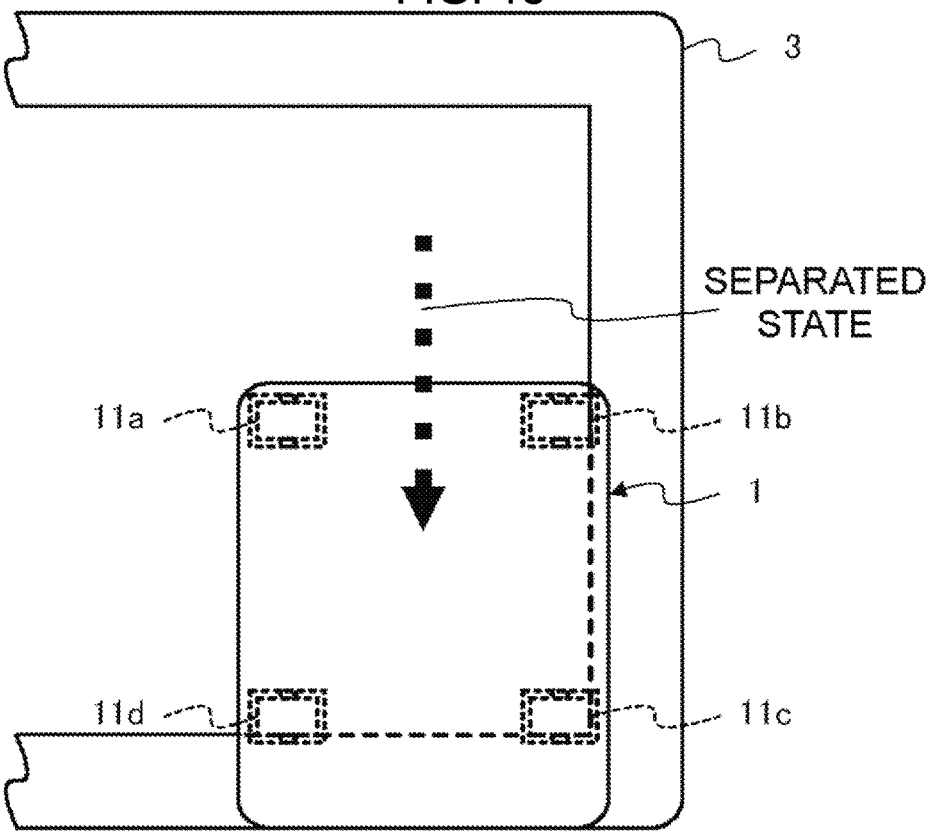
FIG. 13 is a top view of the printing device and the printing assist jig according to Embodiment 2.

As the rotating roller 11*b* reaches the top right corner of the inner edge of the printing assist jig 3, as shown in FIG. 13, the user lifts and moves the printing device 1 in the direction indicated by the arrow to the position where the rotating roller 11*c* makes contact with the bottom right corner of the inner edge of the printing assist jig 3. Meanwhile, the printing device 1 is separated from the print medium 2 and does not print.

Figure 14:
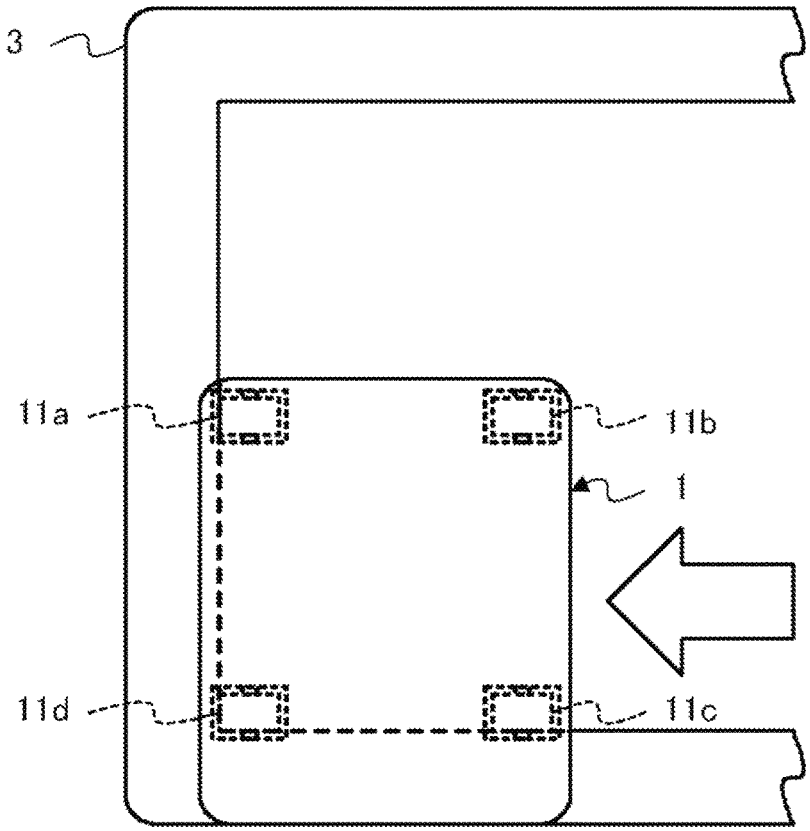
FIG. 14 is a top view of the printing device and the printing assist jig according to Embodiment 2.

As the rotating roller 11*c* makes contact with the bottom right corner of the inner edge of the printing assist jig 3, as shown in FIG. 14, the user moves the printing device 1 in the backward direction indicated by the arrow until the rotating roller 11*d* reaches the bottom left corner of the inner edge of the printing assist jig 3. Meanwhile, the print controller 54 controls the print mechanism 20 to print the second print image in the backward direction on the print medium 2.

Including the above configuration and executing the print procedure, the printing device 1 according to Embodiment 2 yields, in addition to the same effect as the effect the printing device 1 according to Embodiment 1 yields, the effect of moving the printing device 1 without meandering in a range that is predetermined by the printing assist jig 3 and realizing printing with less distortion.

In Embodiment 2, as in the case of Embodiment 1, it is assumed that the printing device 1 has the rotating rollers 11*d* to 11*d*. However, in Embodiment 2, four protrusions that are the same in shape as the rotating rollers 11*d* to 11*d* but do not rotate may be provided at the same positions as the rotating rollers 11*a* to 11*d* in place of the rotating rollers 11*a* to 11*d*.

(Modified Embodiments)

Several embodiments of the present disclosure are described above. These embodiments are given by way of example and the scope of application of the present disclosure is not confined thereto. In other words, embodiments of the present disclosure find various applications and any embodiments are included in the scope of the present disclosure.

It is assumed that the print head 22 heats the ink within the nozzles 23 with a heater to form air bubbles and ejects the ink from the individual nozzles 23 to the print medium 2 by means of the formed air bubbles. However, this is not restrictive. The ink may be pushed out from the nozzles by a piezo-element or the ink that is pushed out by a pump may be atomized by ultrasonic waves.

It is assumed that the print mechanism 20 includes the ink tank 21 and the print head 22 and performs inkjet printing. However, this is not restrictive. Any print system including thermal print and thermal transfer print may be performed.

It is assumed that the detection device 30 includes the light source 31 and the image sensor 32 and with the image sensor 32 reading light that is emitted by the light source 31 and reflected on the print medium 2, the detection device 30 detects the amount of movement. However, this is not restricted. The detection device 30 may include a roller or a ball that is disposed on the bottom surface of the enclosure 10 and detects the amount of movement by detecting their rotation. Moreover, it may be possible that a laser light source is included and with the image sensor 32 reading light that is emitted by the laser light source and reflected on the print medium 2, the amount of movement is detected.

In Embodiment 2, the printing assist jig 3 is not restricted to a single printing assist jig. It may be possible to prepare multiple printing assist jigs 3 that are different in measurement in at least one of the x-direction and the y-direction and selectively use a suitable printing assist jig 3 depending on the length of an image or the size of characters to print or the like among the multiple printing assist jigs 3.

The explanation is made on the assumption that the direction of printing from left to right is the forward direction and the direction of printing from right to left is the backward direction. However, this is not restrictive. The direction of printing from right to left may be the forward direction. Moreover, the direction of printing from top to bottom may be the forward direction. Additionally, any direction can be the forward direction.

Moreover, any method of applying such programs can be used. For example, the pragmas can be saved on a computer-readable storage medium such as a flexible disc, a compact disc (CD)-ROM, a digital versatile disc (DVD)-ROM, and a memory card and applied. Furthermore, the programs can be superimposed on carrier waves and applied via a communication medium such as the Internet. For example, the programs may be posted on a bulletin board system (BBS) on a communication network and distributed. Then, the programs are started and executed in the same manner as other application programs under the control of an operating system (OS) so as to execute the above-described procedure.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a print head that prints an image on a print medium while moving relatively to the print medium;

a sensor that detects an amount of movement and a moving direction of a body of the printing device relative to the print medium; and a processor, wherein the processor:

controls the print head to execute printing of a first image according to the amount of movement when the moving direction detected by the sensor is a first direction, and controls the print head to execute printing of a second image according to the amount of movement when the sensor detects movement in a second direction that is a direction different from the first direction, wherein the processor controls the print head to insert a space when executing printing of the second image so as to substantially align a head of the first image and a head of the second image.

2. The printing device according to claim 1, further comprising:

rotating rollers that restrict the moving direction to the first direction and the second direction and prevent, while the body is moving in the first direction or the second direction, the body from moving in a direction that is different from the first direction and the second direction.

3. The printing device according to claim 2, wherein the rotating rollers are configured so as to make contact with an inner edge of a printing assist jig that is placed on the print medium and that comprises a rectangular frame that encloses a region where the image is to be printed.

4. The printing device according to claim 1, wherein the first image is an n-th line image (n is an integer equal to or greater than 1) of a multiline print-target image and the second image is an n+1-th line image of the print-target image.

5. The printing device according to claim 1, wherein:

the first direction is a direction from one of a right end and a left end of the print medium to another end of the print medium, the second direction is a direction from the other of the right end and the left end of the print medium to the one end of the medium, and the processor:

controls the print head to print the first image according to the amount of movement when the first direction is detected as the moving direction, acquires a moving distance from a position where the print head starts printing of the first image to a position which is a position at which to place the print head in order to print the second image, acquires a difference between the moving distance and a length of the second image along the second direction, creates a second print image in which the space, which has a length along the second direction equal to the difference, is added at an end of the second image, and causes the print head to print the second print image according to the amount of movement when the second direction is detected as the moving direction.

6. The printing device according to claim 5, wherein:

the first image has a first length along the first direction, and the second image has a second length along the first direction, and the printing device further comprises a notifier that (i) gives notice that the moving distance exceeds the first length if the first length is equal to or larger than the second length or (ii) gives notice that the moving distance exceeds the second length if the second length is equal to or larger than the first length.

7. The printing device according to claim 1, wherein:

the processor acquires a moving distance from a position where the print head starts printing of the first image to a position which is a position at which to place the print head in order to print the second image, the first image has a first length along the first direction, and the second image has a second length along the first direction, and the printing device further comprises a notifier that (i) gives notice that the moving distance exceeds the first length if the first length is equal to or larger than the second length or (ii) gives notice that the moving distance exceeds the second length if the second length is equal to or larger than the first length.

8. The printing device according to claim 1, wherein the space is inserted at a position adjacent to one of a beginning of the second image and an end of the second image.

9. The printing device according to claim 1, wherein the processor determines an amount of the space based on a distance from a position of an end of the first image to a position at which to place the print head in order to print the second image.

10. The printing device according to claim 1, wherein the processor determines an amount of the space based on a distance from a position of an end of the first image to a position at which to separate the print head from the print medium.

11. The printing device according to claim 1, wherein the first direction is opposite to the second direction.

12. The printing device according to claim 1, wherein the processor determines an amount of the space based on a difference between a first distance and a second distance, the first distance being a distance from a position of an end of the first image to a position at which to place the print head in order to print the second image, and the second distance being a distance based on a length of the second image.

13. A printing method that is executed by a printing device, the printing device comprising a print head that prints an image on a print medium while moving relatively to the print medium, and a sensor that detects an amount of movement and a moving direction of a body of the printing device relative to the print medium, the printing method comprising:

controlling the print head to print a first image according to the amount of movement when one of a first direction and a second direction that is a direction different from the first direction is detected as the moving direction, and controlling the print head to execute printing of a second image according to the amount of movement when the sensor detects movement in the other of the first direction and the second direction, wherein the controlling controls the print head to insert a space when executing printing of the second image so as to substantially align a head of the first image and a head of the second image.

14. A non-transitory computer readable recording medium on which a program is recorded, the program being executable by a computer of a printing device comprising a print head that prints an image on a print medium while moving relatively to the print medium, and a sensor that detects an amount of movement and a moving direction of a body of the printing device that are relative to the print medium, and the program being executable by the computer to control the computer to execute processing comprising:

controlling the print head to execute printing of a first image according to the amount of movement when one of a first direction and a second direction that is a direction different from the first direction is detected as the moving direction, and controlling the print head to execute printing of a second image according to the amount of movement when the sensor detects movement in the other of the first direction and the second direction, wherein the controlling controls the print head to insert a space when executing printing of the second image so as to substantially align a head of the first image and a head of the second image.

* * * * *